US006200050B1

(12) United States Patent
Lin

(10) Patent No.: US 6,200,050 B1
(45) Date of Patent: Mar. 13, 2001

(54) AUTOMATIC BOUNCE DEVICE FOR A CENTER STICK IN A PEN

(76) Inventor: Casio Lin, 5F, No. 16, Alley 65, Lane 14, Sec. 7, Chung San N. Road, Taipei (TW)

( * ) Notice: Subject to any disclaimer, the term of this patent is extended or adjusted under 35 U.S.C. 154(b) by 0 days.

(21) Appl. No.: 09/512,463

(22) Filed: Feb. 24, 2000

(51) Int. Cl.[7] ..... B43K 24/02
(52) U.S. Cl. ..... 401/104; 401/109
(58) Field of Search ..... 401/104–106, 401/109

(56) References Cited

U.S. PATENT DOCUMENTS 5,688,063 * 11/1997 Yu et al. ..... 401/109

FOREIGN PATENT DOCUMENTS

65642 * 2/1956 (FR) ..... 401/104
1178230 * 5/1959 (FR) ..... 401/104
1336207 * 7/1963 (FR) ..... 401/104
1351513 * 12/1963 (FR) ..... 401/104

* cited by examiner

*Primary Examiner*—Charles R. Eloshway
(74) *Attorney, Agent, or Firm*—Dougherty & Troxell

(57) ABSTRACT

An automatic bounce device for a center stick in a pen comprises a pen holder, a center stick, a restore resilient part, and a push part. A locating hole and an engaging hole is provided on the pen holder. The push part is composed of an upper cap and a lock key tube. The upper cap movably fits with an opening end on the pen holder and a clip extends from the upper cap. The clip has a projection corresponding to the locating hole. The key tube is sleeved in the opening end and extends out of the pen holder. A inverse elastic hook part with an engaging hook is provided on the lock key tube and the center stick is received in the key tube. When the lock key tube is pressed, the engaging hook is moved away the engaging hole and slides into the locating hole to expose the nib on the center stick. When the clip is pressed, the projection pushes the engaging hook away the locating hole and the center stick and the key tube are moved back by way of the elasticity of the resilient part and the flexibility of the buckled center stick. Thus, the engaging hook is received in the engaging hole again.

2 Claims, 4 Drawing Sheets

AUTOMATIC BOUNCE DEVICE FOR A CENTER STICK IN A PEN

BACKGROUND OF THE INVENTION (a) Field of the Invention

The present invention relates to an automatic bounce device for a center stick in a pen, and particularly to a bounce device, with which a push part is provided at an opening end of a hollow pen holder. Thus, a nib part of a standardized center stick in the pen holder can be exposed for writing from a state of concealing in the pen holder by way of pressing the push part.

(b) Description of the Prior Art

A conventional bounce type of center stick in a pen is widely adopted in our daily life. As shown in FIG. 1, a prior art automatic bounce device for a center stick in a pen provides a hollow pen holder A10 and a head end of the pen holder A10 has attached a clip A11 extending outwardly therefrom. The clip A11 at an end thereof has an engaging projection A12 jutting out from an inner side thereof. A locating hole A13 is provided on the pen holder A10 corresponding to the projection A12. A lock hole A14 is located at a place near the lock hole A13 on the pen holder A10. In addition, the pen holder A10 receives a center stick A15 and the center stick A15 has a nib part A16 at an end thereof. A pair of flips A17 are opposite to each other and disposed near the nib part A16 on the center stick A15. A restore spring A18 is placed in the pen holder A10 around the center stick A15 by the flips A17. The other end of the center stick A15 contacts with a bounce device A20 and the bounce device A20 has a push head A21 to extend outward from the head end of the pen holder A10 to be pressed while in use. Furthermore, a touch post A22 on the bounce device A20 extends inward and a leaf spring hook A23 is attached to the touch post A22 in a slightly outward inclination to fit a inverse hook thereof with the lock hole A14.

Once the above said components of the prior art bounce device are assembled completely, the leaf spring hook A23 moves away from the lock hole A14 and slides into the locating hole A13 when pressing the push head A21. In this way, the nib part A16 of the center stick A15 is forced to an exposed position outside the pen holder A10. Having been pressed, the clip A11 has the projection A12 thereof to push the leaf spring hook A23 and to move from the locating hole A13, and a resilient force of the restore spring A18 moves the center stick A15 with the leaf spring hook A23 upward. In this way, the leaf spring hook A23 engages with the lock hole A14 again. However, the prior art bounce device has the following drawbacks:

1) The center stick applied in the prior art bounce device has a length limited by the length of the pen holder and by a room in the pen holder for receiving the bounce device. Therefore, the length of the center stick is shorter than a standard length (about 14 centimeters) used in an ordinary cap type pen such that a special size for the center stick used in the bounce type pen has to be made.

2) Owing to a shorter center stick, the ink contained therein is less and it results in a writing span is limited to about 1,500 meters. Thus, a utilized period becomes shorter such that it is unable to compete with the standard sized center stick. (The writing span for the standard sized center stick is around 2,500 meters.)

3) The prior art bounce device has to be fixed in the pen holder in contact with the center stick. It is not easy to be assembled and it results in a higher production cost.

The above drawbacks leads to a pen provided with the prior art bounce device having a higher price such that it is not as popular as the conventional cap type pen even if the cap on the conventional pen is lost frequently while in use. Therefore, a revised bounce device has to be developed so as to allow the length of a center stick in a pen to be identical with a standardized center stick used in the conventional cap type pen and to allow the device being simply assembled. Then, the requirements such as lengthening the writing span and lowering the production cost can be met advantageously.

SUMMARY OF THE INVENTION

An automatic bounce device for a center stick in a pen in accordance with the present invention comprises a pen holder, a center stick, a resilient part, and a push part. The characteristics of the automatic bounce device resides in that the push part is provided at an opening end of the pen holder and the push part is composed of an upper cap and a lock key tube. The upper cap movably fits with and encloses the opening end and a clip extends from the upper cap. A free end of the clip has a projection jutting out of an inner side thereof corresponding to a locating hole on the pen holder. The key tube is closed at an end thereof and sleeved in the opening end with part of the length thereof extending out of the pen holder. An elastic inverse hook part with an engaging hook is provided on the key tube and the center stick at an end thereof is received in the key tube and keeps contact with the closed end of the key tube. When the key tube is pressed, the engaging hook on the elastic hook part moves away an engaging hole on the pen holder and slides into the locating hole. In the mean time, the center stick is pushed to expose a nib part at another end thereof outside the pen holder and the center stick is caused to buckle. When the clip is pressed, the projection thereon pushes the engaging hook away the locating hole and the center stick and the key tube are moved back by way of the elasticity of the resilient part and the flexibility of the buckled center stick. Thus, the engaging hook is then received in the engaging hole again.

Accordingly, an object of the present invention is to provide an automatic bounce device for a center stick in a pen with which a conventional standardized center stick can be used such that a longer useful writing span can be reached without any difficulty.

Another object of the present invention is to provide an automatic bounce device for a center stick in a pen with which a conventional standardized center stick can be used without the need for a special size to ease a replacement of the center stick.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
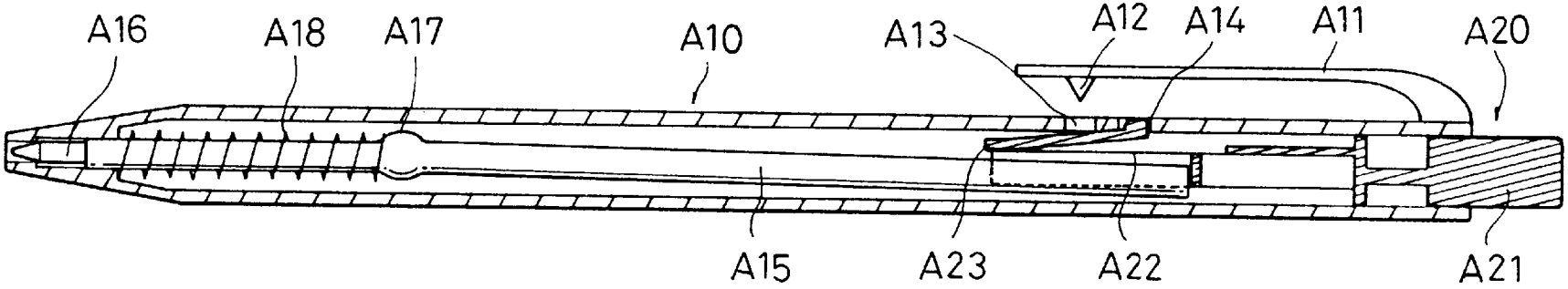
(PRIOR ART) FIG. 1
FIG. 1 is sectional view of a bounce device for a pen in a prior art.
Figure 2:
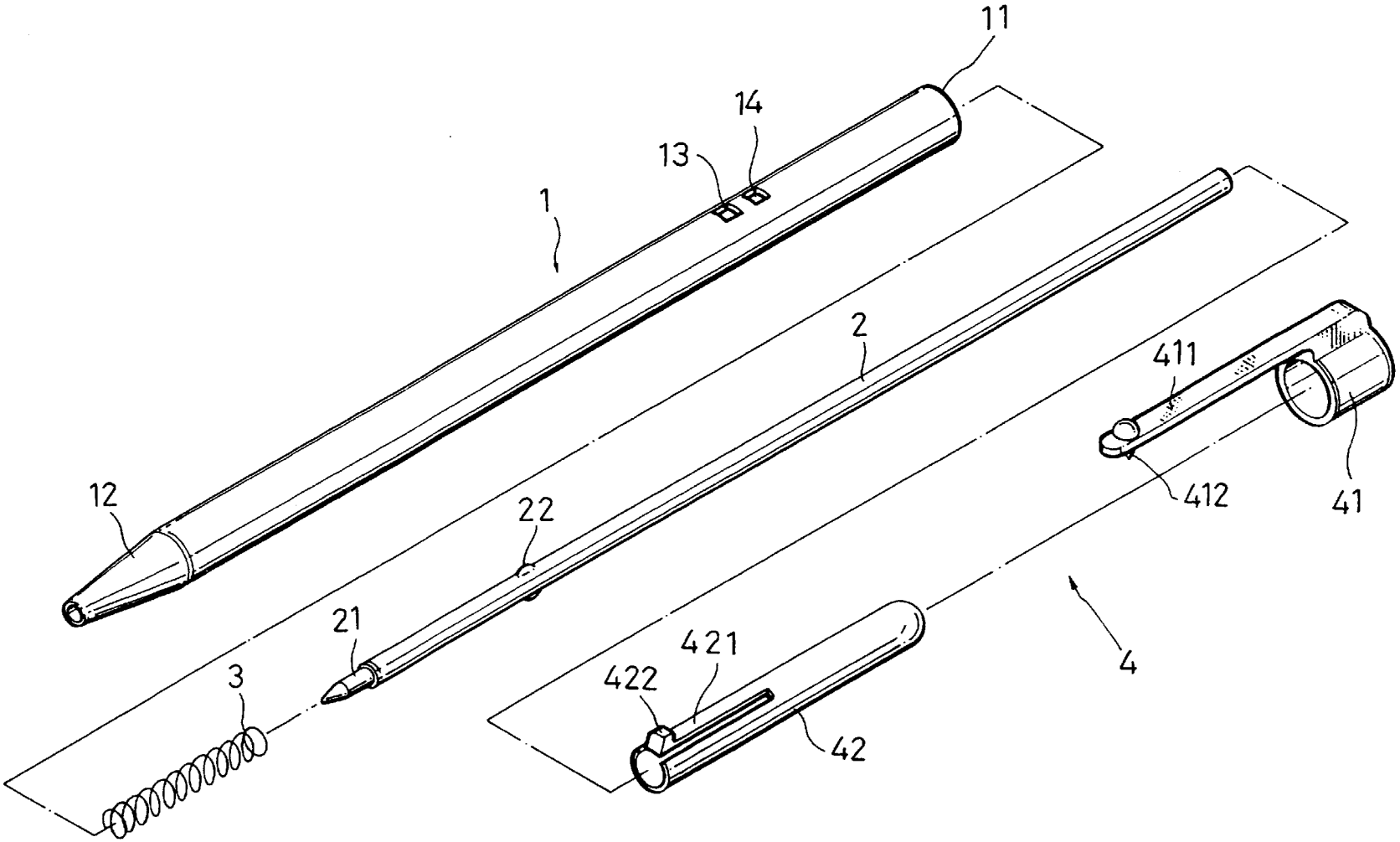
FIG. 2 is an exploded perspective view of an automatic bounce device for a center stick in a pen according to the present invention.
Figure 3:
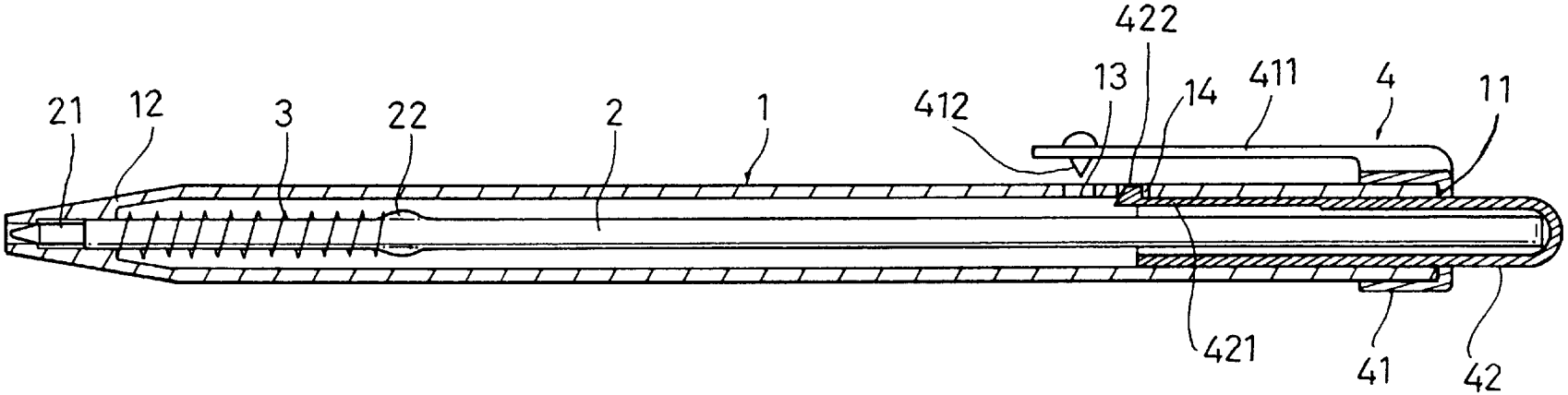
FIG. 3 is a assembled sectional view of the automatic bounce device shown in FIG. 2 illustrating the pen being in a retracted state.
Figure 4:
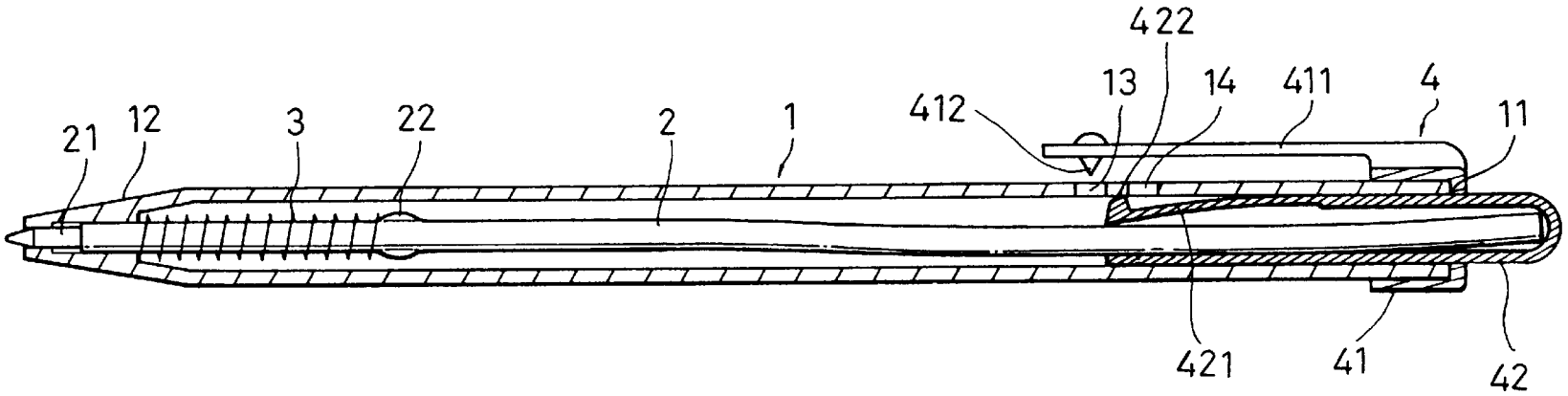
FIG. 4 is a sectional view similar to FIG. 3 illustrating the pen in a state of being pressed.

Referring to FIGS. 2 to 4, an automatic bounce device for a center stick in a pen according to the present invention basically comprises a pen holder 1, a center stick 2, a resilient part 3 and a push part 4.

The pen holder 1 has a shape about the same as the prior art pen holder and is hollow with an opening end 11 and a conical writing end 12. An engaging hole 14 is disposed on the pen holder 1 near the opening end 11 and a locating hole 13 is arranged on the pen holder 1 straight below the engaging hole 14.

The center stick 2 has a nib part 21 at an end thereof and is placed in the pen holder 1. The other end of the center stick 2 is received in the push part 4. The center stick 2 has a length in accordance with the standardized specification such that more ink can be filled in the center stick to extend the writing span to about 2,500 meters and to lengthen the utilized period.

The resilient part 3 is a spring in the preferred embodiment and is disposed between the inner side of the writing end 12 and the two flips 22 on the center stick 2. The spring 3 is compressed while the center stick 2 is pressed to move outward and extends while the center stick 2 is relieved from being pressed.

The push part 4 is located at the opening end 11 and is composed of an upper cap 41 and a key tube 42. The upper cap 41 movably fits with and encloses the opening end 11 and a clip 411 is attached to the upper cap 41 on the outer surface thereof and extends outwards. The clip 411 at a free end thereof has a projection 412 jutting out of an inner surface thereof corresponding to the locating hole 13. The key tube 42 is sleeved in the opening end 11 and a part of the key tube 42 extends out of the opening end 11 for pressing while in use. The key tube 42 is hollow with a closed end to receive the end of the center stick 2. A inverse elastic hook part 421 is on the key tube 42 with an engaging hook 422 at a free end thereof. The engaging hook 422 can be locked in the locating hole 13 and in the engaging hole 14 respectively. It is noted that the upper cap 41 and the pen holder 1 can be associated with each other integrally in the practical application.

Referring to FIG. 4 again, when the key tube 42 is pressed, the engaging hook 422 on the hook part 421 moves away the engaging hole 14 and slides into the locating hole 13. Thus, the center stick 2 is forced to be buckled and to displace a distance so as to expose the nib part 21 outside the writing end 12 while in use. Referring to FIG. 3 again, when the clip 411 is pressed, the projection 412 pushes the engaging hook 422 away the locating hole 13. Thus, the center stick 2 and the hook part 421 are forced to move back by way of the elasticity of the resilient part 3 and the flexibility of the buckled center stick and the engaging hook 422 then moves into the engaging hole 14 again. In this way, the center stick 2 is not in a state of being buckled again. Therefore, the nib part 21 can be pushed to move out of the pen holder 1 while in use and displaces to the original position in the pen holder 1 while not in use.

It is noted that the automatic bounce device for a center stick in a pen according to the present invention is able to use a center stick of standardized length as the cap type pen does. Hence, the writing span can be reached to about 2,500 meters and a longer life for a pen can last. In addition, it is much more convenient for a user to replace a new center stick and it is not necessary to consider if a special specification is needed or not. Moreover, the function of the resilient part and the buckled center stick causing the center stick and the key tube to move back automatically is possible to last a life of at least 100,000 actuating times. It is appreciated that the key tube receives a standardized center stick and the hook part does not extend obliquely so that movement of the hook part with the engaging hook requiring a help of the buckled center stick is a great innovation never seen before. Also, it is advantageous that the push part in the bounce device of the present invention provides a simple arrangement and is easy to assemble. Therefore, the push part can be made in a way of mass production to lower the production cost such that the price of a pen with a bounce device in accordance with the present invention can be less than the cap type pen absolutely.

While the invention has been described with reference to preferred embodiment thereof, it is to be understood that modifications or variations may be easily made without departing from the spirit of this invention, which is defined by the appended claims.

What is claimed is:

1. A pen having a retractable center stick and comprising:

a) a hollow pen holder casing having an open end and a writing end, the hollow pen holder having a length;

b) a center stick with a supply of ink located within the hollow pen holder casing and having a writing nib on a first end, a length of the center stick being greater than the length of the hollow pen holder such that a second end of the center stick extends out of the open end of the hollow pen holder;

c) an engaging hole in the hollow pen holder;

d) a locating hole in the hollow pen holder spaced from the engaging hole;

e) a resilient element acting on the center stick;

f) an upper cap attached to the hollow pen holder casing at the open end, the upper cap having a clip extending therefrom, the clip having a projection at a distal end thereof aligned with the locating hole; and, g) a key tube enclosing the second end of the center stick extending from the open end of the hollow pen holder, the key tube passing through the upper cap and having an elastic portion with a hook extending therefrom, whereby in a first position of the center stick, the hook engages the engaging hole when the writing nib is within the hollow pen holder casing, and exertion of a force on the key tube moves the center stick to a second position in which the writing nib is exposed outside of the writing end and the hook engages the locating hole, the hook being disengaged from the locating hole by moving the distal end of the clip such that the projection contacts the hook, whereby the center stick is returned to the first position by the resilient element, the length of the center stick being such that the center stick is buckled when in the second position.

2. The pen of claim 1 wherein the resilient element comprises a spring.

* * * * *